US006374175B1

(12) United States Patent
Verron et al.

(10) Patent No.: US 6,374,175 B1
(45) Date of Patent: Apr. 16, 2002

(54) METHOD OF USING MEMORIES IN AID OF VEHICLE NAVIGATION

(75) Inventors: Serge Verron, Rambouillet (FR); Bernhardt Klein, Asslar; Thomas Konrad, Neunkirchen, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/367,982

(22) PCT Filed: Dec. 14, 1998

(86) PCT No.: PCT/IB98/02022

§ 371 Date: Aug. 23, 1999

§ 102(e) Date: Aug. 23, 1999

(87) PCT Pub. No.: WO99/34343

PCT Pub. Date: Jul. 8, 1999

(30) Foreign Application Priority Data

Dec. 23, 1997 (FR) ..... 97 16308

(51) Int. Cl.[7] ..... G08G 1/0967; H04H 1/00

(52) U.S. Cl. ..... 701/200; 701/117; 379/133

(58) Field of Search ..... 701/200, 211, 701/208, 117; 340/990, 995, 996; 379/113, 133; 455/186.1

(56) References Cited

U.S. PATENT DOCUMENTS

| | | | | | |
|---|---|---|---|---|---|
| 5,303,401 | A | * | 4/1994 | Duckeck et al. | 455/186.1 |
| 5,345,606 | A | * | 9/1994 | Duckeck et al. | 455/186.1 |
| 5,493,709 | A | * | 2/1996 | Duckeck et al. | 455/185.1 |
| 5,649,300 | A | * | 7/1997 | Snyder et al. | 455/517 |
| 5,913,157 | A | * | 6/1999 | Ruhl | 455/186.1 |
| 6,173,165 | B1 | * | 1/2001 | Ruhl et al. | 455/186.1 |

FOREIGN PATENT DOCUMENTS

| | | | |
|---|---|---|---|
| GB | 19608538 | 3/1996 | G08G/1/0968 |

* cited by examiner

*Primary Examiner*—Tan Nguyen
(74) *Attorney, Agent, or Firm*—Morrison & Foerster, LLP

(57) ABSTRACT

A vehicle navigation system includes a message transmitter/receiver capable of holding a dialog with a central database under the control of a processor to request and obtain information signals. Messages are received in the form of a cession of reference numbers, and the processor searches its local database for intelligible data corresponding to each reference number. Since the local database contains a limited capacity, for certain reference numbers the corresponding intelligible data will not be in the memory. The processor then begins a dialog by means of the transmitter/receiver, between itself and a central database, so as to obtain the lacking data that corresponds to a received reference number.

7 Claims, 1 Drawing Sheet

METHOD OF USING MEMORIES IN AID OF VEHICLE NAVIGATION

BACKGROUND OF THE INVENTION

1. Field of the Invention

The present invention relates to a method of using memories, notably in aid of vehicle navigation, in which a bidirectional link is provided between a transmitter/receiver with a memory, called local memory and a server with a memory called central memory. The memories contain, inter alia, geographical data such as type and number of road, place, direction.

The invention also relates to a system including user information means, a processor for controlling said information means, and a message transmitter/receiver capable of having a dialog with a remote central database under the supervision of the processor for requesting and obtaining information.

2. Description of the Related Art

A navigation system for vehicles that makes use of a bidirectional link is known from document DE 196 08 538. According to this document, the system receives by means of a receiver encrypted information targeted as a function of the position of the transmitter, and transmits to a central database via a transmitter a request for a key to decode the encrypted information.

A disadvantage of such systems is their relative slowness and possible cumbersomeness of the transmission channels and the cost of transmissions; because the information is sent to the users in full.

SUMMARY OF THE INVENTION

In an embodiment of the invention, within the framework of a particular message coding mode, to provide a system that performs better and saves memory space.

For this purpose, with a message being received in the form of reference numbers each denoting a standard message element supposed to be present in a local database, then a message comprising reference numbers is received, the standard message elements corresponding to the reference numbers are searched for in the local database and, if one of them is not there, a call from the server is launched and the latter transmits the lacking element in response, and the message is processed thereafter.

In a system, with a message being received in the form of reference numbers each denoting a standard message element so that the processor is supposed to find in the local database the standard message element corresponding to a reference number as a function of the received reference number, the local database includes a limited quantity of standard message elements so that, for certain reference numbers, the corresponding message element is not present in the local database, and the processor includes means for starting a dialog by means of the transmitter/receiver between itself and the central database so as to obtain the lacking standard message element corresponding to the reference number.

Particular embodiments of the invention are described hereinafter.

These aspects of the invention as well as other more detailed aspects will appear more clearly regarding to the following description of a preferred embodiment constituting a non-limitative example.

DETAILED DESCRIPTION OF THE PREFERRED EMBODIMENTS

The system described hereafter includes a radio receiver intended to receive and to make use of navigation signals. It is evident that the expert would be able to adapt this description to the case of whatever system intended to receive and make use of signals, for example, a navigation system of the type known by the name of "CARIN" or "SOCRATES". Of course, the invention may be applied within the scope of any standard that specifies significant characteristics, notably, in a system of navigation data transmission via the cellular GSM system.

Figure 1:
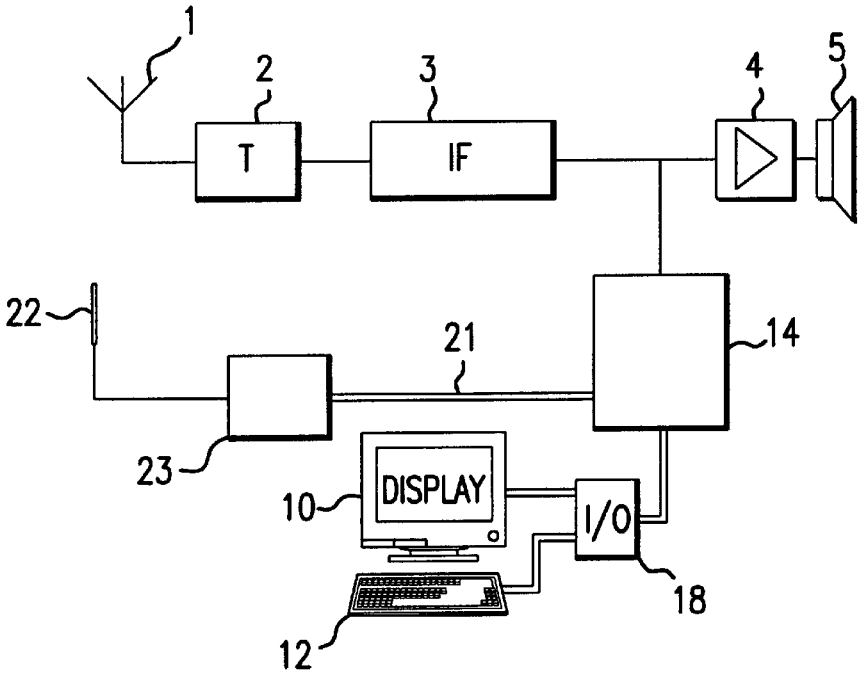
FIG. 1 diagrammatically shows a system according to the invention.

The receiver of FIG. 1 comprises not only an antenna 1, but also a tuner 2 including a tuning circuit and a frequency changing circuit, followed by a device 3 including an intermediate frequency amplifier and a demodulator, followed by an audio amplifier 4 followed by a loudspeaker 5.

The receiver further includes a transmission/receiving module 23 similar to a cellular mobile telephone, for example of the GSM type, with its own antenna 22 and further including an integrated MODEM for the transmission of digital data.

Traffic information messages are incorporated in certain digital signals received by the receiver, for example: "traffic jam three kilometers at Rambouillet." A message is formed by putting reference numbers together that each denote a standard information element included in a memory location of the receiver, defining, for example, the location concerned via an event, the direction of the respective route etc.

For processing the navigation messages, the receiver comprises a module 14 to which the data received by radio are taken by a bus 21 to be analyzed and finally stored, and a user's information means, here the audio amplifier system 4 followed by a loudspeaker 5, for enabling to deliver messages in the form of voice, and an input/output interface 18 connected to a display 10, for example, a liquid crystal display, so as to enable to display messages in written form. To ensure an interaction with the user, the input/output interface 18 is connected to a control keyboard 12.

A standard information element is to be processed in order to express at an audible voice level or in writing what it is about. Therefore, a memory is provided in which are stored, corresponding with each standard information element, clear info tin in the form, for example of ASCII codes of characters of a part of the message to be displayed, and/or of the phoneme sequence (for the memory, a phoneme is a sound unit of a language) that corresponds thereto.

The method used for controlling the memory is the following: when a message comprising reference numbers is received, of which at least one reference number denotes a geographical data, the data corresponding to this reference number is searched for in the local memory and, if it is not there, a server is invoked which transmits the lacking data in response, which data is written in the local memory, and the message can then be processed. The method is advantageously applied to geographical data, but it may nevertheless also be applied to any other type of data.

Figure 2:
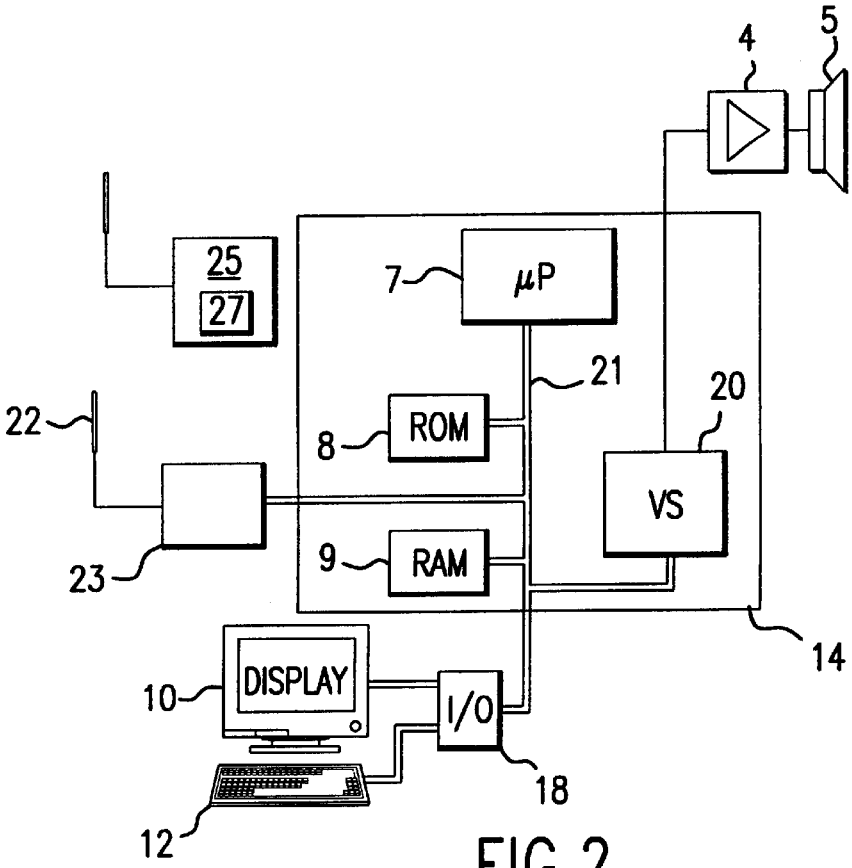
FIG. 2 represents in more detail the part to which the invention r connections with the rest of the system.

The module 14 is shown in more detail FIG. 2, comprises a processor 7 which generates control signals and processes the signals that leave the various devices to which it is connected by the bus 21. The module 14 also comprises various memories, a volatile memory 9 called "AM", for storing valid data at a given instant, a non-volatile memory

8 for example of the type called "flash" memory for storing fixed vocabulary descriptions non-recurrently via the standard for a given language, which correspond with each reference number. The memory 8 is provided for storing, inter alia, data called geographical data such as the type and number of the road, place, direction and so on. The memory 8 may comprise two parts of which one is stored at the factory in advance and the other is loaded on demand by radio link.

The processor 7 selects and prepares digital data, for example, a sequence of ASCII characters to be displayed on the display 10, or symbols each denoting a phoneme, which enable a voice synthesis module 20 known per se to deliver signals to the audio; amplifier 4.

The transmission/receiving module 23 is connected to the processor 7 via the bus 21 and is capable of exchanging messages with a remote central database 25 including central memory 27 under the control of the processor 7, to request and obtain information. A person of ordinary skill in the art knows how to realize such a module.

For certain navigation messages, the processor is supposed to find in the local database a word denoting a text corresponding to a reference number, to display the word on the screen or announce it through the loudspeaker as a function of the received reference number. Yet the local database contains a limited quantity of information signals, so that for certain digital words the corresponding message element is not present in the memory. A processor comprises means, that is, a program, for controlling the transmitter/receiver 23 so as to control a dialog between itself and the remote central database in order to obtain the lacking message element that corresponds to a reference number.

An example of the sequence is the following:

1: a message is received relating to the position whose reference number is 100, 2: the reference number 100 is unknown in a memory of the receiver, the latter thus asks the server for information, 3: the data corresponding to the reference number 100 are transmitted to the receiver, 4: the receiver writes the data in its memory RAM 9 or in the part reserved for this purpose of the flash memory 8 and then processes the message received in 1, 5: a new message is received which also relates to the position 100, 6: the memory now contains the position 100; the receiver searches in its memory, recognizes that the position 100 is already present, and the message is processed immediately.

In practice, the messages are transmitted from the server to the receiver via a channel known by the name of SMS channel; the requests for information on the part of the transmitter/receiver are sent via the same channel or via a channel known by the name of bearer service channel; the requested data are transmitted via either of the two channels.

A system leaves its factory with an empty memory or only partly filled memory; it includes means, that is, a program in a memory of the processor 7 for realizing while being connected to an external database, the loading of the memory 8 with message elements which correspond to reference numbers which are useful to permanently have in the local memory. Criterions for estimating the usefulness of the elements are, for example: the element used most often, used the least, used currently, etc. For obtaining the message elements, the processor can use, for example, a database present at a dealer's and provided for the initial loading of the system by the dealer, but it may also use the transmitter/receiver 23 in a dialog with the central database of the server.

Other means are provided, also formed by a program in a memory of the processor 7, for writing control data of the memory in order to enable a dynamic control of the elements in this memory. A dynamic control comprises deciding which elements are to be withdrawn when the memory is full, which elements are to be replaced by an update by means of a dialog with the server and based on data of the central database. The control data are, for example, data relating to the elements in the memory: date of first use, of last use, etc., or also details about the use of the elements: the order in which they have been received, the order in which they have been used, the frequency of use, etc.

It is evident that, depending on the category of the system, particular choices may be made:

lower-range system: no memory, the data are each time requested from the server, medium range system: little memory capacity, the data most frequently used are stored so as to reduce the cost of communications, upper range system: extended memory with a complete database, acceptable, for example, if a database on a CD-ROM is already provided, which maximizes the reduction of the cast of connection.

What is claimed is:

1. A method of using memories, comprising:

linking a transmitter/receiver with a local memory and a server with a central memory, the local and central memories including geographical data;

receiving a message in the form of reference numbers, each message denoting a standard message element stored in a local database;

searching the standard message elements corresponding to the reference numbers in the local database, and launching a call from the server when the standard message element is not found during the search; and transmitting the standard message element not found and processing the message.

2. A system, comprising:

a user information device;

a processor to control the information device; and a message transmitter/receiver communicating with a central database under the supervision of the processor to request and obtain information, wherein a message is received in the form of reference numbers, each message denoting a standard message element configured for storage in the local database, the standard message element corresponding to a reference number, and when a standard message element corresponding to a reference number is not present in the local database, the processor initiates communication via the transmitter/receiver and the central database to obtain the standard message element corresponding to the reference number.

3. A system as claimed in claim 2, wherein the processor loads the local database with standard message elements corresponding to reference numbers which are permanently stored the local database.

4. A system as claimed in claim 3, wherein the processor communicates with the transmitter/receiver and the central database for obtaining standard message elements.

5. A system as claimed in claim 2, further comprising a memory to store control data of the database to update the database by communicating with the server, based on data in the central database.

6. A system as claimed in claim 5, wherein the control data comprises dates.

7. A system as claimed in claim 5, wherein the control data comprises at least one of dates relating to the standard message elements in the memory and details relating to the use of the standard message elements.

* * * * *